US008886112B2

(12) United States Patent
Lee et al.

(10) Patent No.: US 8,886,112 B2
(45) Date of Patent: Nov. 11, 2014

(54) MEDIA DEVICE WITH ENHANCED DATA RETRIEVAL FEATURE

(75) Inventors: Jeffrey Lee, Sunnyvale, CA (US); Michael Ingazio Ingrassia, Jr., San Jose, CA (US)

(73) Assignee: Apple Inc., Cupertino, CA (US)

( * ) Notice: Subject to any disclaimer, the term of this patent is extended or adjusted under 35 U.S.C. 154(b) by 978 days.

(21) Appl. No.: 12/237,264

(22) Filed: Sep. 24, 2008

(65) Prior Publication Data

US 2010/0075593 A1 Mar. 25, 2010

(51) Int. Cl.

| | |
|---|---|
| ***H04H 40/00*** | (2008.01) |
| ***H04H 60/64*** | (2008.01) |
| ***H04H 60/73*** | (2008.01) |
| *H04H 20/40* | (2008.01) |
| *H04H 60/37* | (2008.01) |
| *H04H 60/74* | (2008.01) |
| *H04H 60/90* | (2008.01) |

(52) U.S. Cl.

CPC ..... *H04H 60/64* (2013.01); *H04H 60/73* (2013.01); *H04H 20/40* (2013.01); *H04H 2201/10* (2013.01); *H04H 60/37* (2013.01); *H04H 60/74* (2013.01); *H04H 60/90* (2013.01); *H04H 2201/13* (2013.01); *H04H 2201/37* (2013.01)

USPC ..... 455/3.06; 455/3.01; 455/3.05; 455/3.03; 455/422.1; 455/403; 725/62; 725/63; 725/68; 725/70; 725/72

(58) Field of Classification Search

CPC ... H04H 60/74; H04H 60/37; H04H 2201/13; H04H 2201/10; H04H 20/40; H04H 60/73

USPC ..... 455/3.01–3.06, 466, 422.1, 403, 455/414.1–414.4, 550.1, 73, 500, 517, 455/412.1, 412.2, 426.1, 426.2; 725/62–72

See application file for complete search history.

(56) References Cited

U.S. PATENT DOCUMENTS

| | | | |
|---|---|---|---|
| 4,476,582 | A | 10/1984 | Strauss et al. |
| 5,341,350 | A | 8/1994 | Frank et al. |

(Continued)

FOREIGN PATENT DOCUMENTS

| | | |
|---|---|---|
| EP | 0744839 | 11/1996 |
| EP | 0898378 | 2/1999 |

(Continued)

OTHER PUBLICATIONS

Orubeondo, "Trim AirCard 300 Eases Power Demands." InfoWorld vol. 21, Issue 48, pp. 46 & 50, Nov. 29, 1999.

(Continued)

*Primary Examiner* — Keith Ferguson

(74) *Attorney, Agent, or Firm* — Blakely, Sokoloff, Taylor & Zafman LLP

(57) ABSTRACT

A personal media device including a broadcast receiver that receives broadcast media and broadcast media data from a broadcast source where the broadcast media data includes a media identifier associated with the broadcast media. The media device also includes a data transceiver that sends a retrieval request to a media server for enhanced media data where the retrieval request includes the media identifier and receives the enhanced media data via a wireless data channel. The media device further includes a processor that performs a media device operation in response to the received enhanced media data.

38 Claims, 10 Drawing Sheets

(56) References Cited

U.S. PATENT DOCUMENTS

| | | | | |
|---|---|---|---|---|
| 5,557,541 | A | 9/1996 | Schulhof et al. | |
| 5,616,876 | A | 4/1997 | Cluts | |
| 5,963,916 | A | 10/1999 | Kaplan | |
| 5,983,073 | A | 11/1999 | Ditzik | |
| 6,047,054 | A | 4/2000 | Bayless et al. | |
| 6,160,551 | A | 12/2000 | Naughton et al. | |
| 6,192,340 | B1 | 2/2001 | Abecassis | |
| 6,247,130 | B1 | 6/2001 | Fritsch | |
| 6,255,961 | B1 | 7/2001 | Van Ryzin et al. | |
| 6,259,892 | B1 | 7/2001 | Helferich | |
| 6,314,094 | B1 | 11/2001 | Boys | |
| 6,338,044 | B1 | 1/2002 | Cook et al. | |
| 6,339,706 | B1 | 1/2002 | Tillgren et al. | |
| 6,353,637 | B1 | 3/2002 | Mansour et al. | |
| 6,401,085 | B1 | 6/2002 | Gershman et al. | |
| 6,407,750 | B1 | 6/2002 | Gioscia et al. | |
| 6,408,332 | B1 | 6/2002 | Matsumoto et al. | |
| 6,418,330 | B1 | 7/2002 | Lee | |
| 6,487,663 | B1 | 11/2002 | Jaisimha et al. | |
| 6,510,210 | B1 | 1/2003 | Baughan | |
| 6,516,466 | B1 | 2/2003 | Jackson | |
| 6,526,335 | B1 | 2/2003 | Treyz et al. | |
| 6,559,773 | B1 | 5/2003 | Berry | |
| 6,587,127 | B1 | 7/2003 | Leeke et al. | |
| 6,609,105 | B2 | 8/2003 | Van Zoest et al. | |
| 6,658,247 | B1 | 12/2003 | Saito | |
| 6,728,531 | B1 | 4/2004 | Lee et al. | |
| 6,772,212 | B1 | 8/2004 | Lau et al. | |
| 6,823,225 | B1 | 11/2004 | Sass | |
| 6,845,398 | B1 | 1/2005 | Galensky et al. | |
| 6,901,067 | B1 | 5/2005 | Kalavade | |
| 6,907,112 | B1 | 6/2005 | Guedalia et al. | |
| 6,915,272 | B1 | 7/2005 | Zilliacus et al. | |
| 6,917,923 | B1 | 7/2005 | Dimenstein | |
| 7,065,342 | B1 | 6/2006 | Rolf | |
| 7,110,714 | B1 | 9/2006 | Kay et al. | |
| 7,187,947 | B1 | 3/2007 | White et al. | |
| 7,339,993 | B1 | 3/2008 | Brooks et al. | |
| 7,440,772 | B2 | 10/2008 | White et al. | |
| 7,444,353 | B1 | 10/2008 | Chen et al. | |
| 7,486,926 | B2 | 2/2009 | White et al. | |
| 7,634,228 | B2 | 12/2009 | White et al. | |
| 8,543,095 | B2 * | 9/2013 | Brown et al. | 455/414.1 |
| 2002/0010759 | A1 | 1/2002 | Hitson et al. | |
| 2002/0046084 | A1 | 4/2002 | Steele et al. | |
| 2002/0049037 | A1 | 4/2002 | Christensen et al. | |
| 2002/0112187 | A1 | 8/2002 | Dalton, Jr. et al. | |
| 2002/0164973 | A1 | 11/2002 | Janik et al. | |
| 2002/0183059 | A1 | 12/2002 | Noreen et al. | |
| 2003/0013425 | A1 | 1/2003 | Nee | |
| 2004/0198279 | A1 | 10/2004 | Anttila et al. | |
| 2004/0198389 | A1 | 10/2004 | Alcock et al. | |
| 2005/0154599 | A1 | 7/2005 | Kopra et al. | |
| 2005/0208913 | A1 | 9/2005 | Raisinghani et al. | |
| 2006/0105781 | A1 | 5/2006 | Ueda et al. | |
| 2006/0184431 | A1 | 8/2006 | Rosenberg et al. | |
| 2006/0184960 | A1 | 8/2006 | Horton et al. | |
| 2007/0016922 | A1 * | 1/2007 | Koch | 725/35 |
| 2007/0208771 | A1 | 9/2007 | Platt | |
| 2007/0232225 | A1 | 10/2007 | Kikuchi | |
| 2008/0039037 | A1 | 2/2008 | Kum | |
| 2008/0133336 | A1 | 6/2008 | Altman et al. | |
| 2008/0139109 | A1 * | 6/2008 | Ewertz | 455/3.01 |
| 2008/0151888 | A1 * | 6/2008 | Ahmed | 370/390 |
| 2008/0160940 | A1 | 7/2008 | Jendbro | |
| 2008/0162358 | A1 | 7/2008 | Patsiokas et al. | |
| 2008/0268772 | A1 | 10/2008 | Linnamaki et al. | |
| 2008/0288378 | A1 * | 11/2008 | Berstis et al. | 705/30 |
| 2009/0005071 | A1 | 1/2009 | Forstall et al. | |
| 2009/0063975 | A1 | 3/2009 | Bull et al. | |
| 2009/0070370 | A1 | 3/2009 | Cunningham et al. | |
| 2009/0100068 | A1 | 4/2009 | Gauba et al. | |
| 2009/0124226 | A1 | 5/2009 | Nakamura et al. | |
| 2009/0125609 | A1 | 5/2009 | Wood et al. | |
| 2009/0158155 | A1 | 6/2009 | Quinn et al. | |
| 2009/0186629 | A1 | 7/2009 | Soelberg et al. | |
| 2009/0326949 | A1 | 12/2009 | Douthitt et al. | |
| 2010/0075593 | A1 | 3/2010 | Lee et al. | |
| 2010/0075616 | A1 | 3/2010 | Haughay, Jr. et al. | |
| 2010/0075695 | A1 | 3/2010 | Haughay, Jr. et al. | |
| 2011/0183603 | A1 * | 7/2011 | Malik | 455/3.01 |
| 2012/0079515 | A1 * | 3/2012 | Wang et al. | 725/9 |

FOREIGN PATENT DOCUMENTS

| | | |
|---|---|---|
| EP | 0918408 | 5/1999 |
| JP | 8-006875 | 1/1996 |
| JP | 11-164058 | 6/1999 |
| JP | 11-242686 | 9/1999 |
| JP | 11-317061 | 11/1999 |
| KR | 1999-0073234 | 10/1999 |
| WO | WO/00-19662 | 5/2000 |
| WO | 00/54462 | 9/2000 |
| WO | 00/70523 | 11/2000 |
| WO | 2007/144030 | 12/2007 |
| WO | WO/2008-080006 | 7/2008 |

OTHER PUBLICATIONS

"Sierra Wireless Announces First Cellular Network Interface Card for Notebook PCs; The AirCard 300 for Windows Changes the Way Notebook PC Users Make Wireless Connections." Business Wire, Jun. 21, 1999 (http://findarticles.com/p/articles/mi_m0EIN/is_1999_June_21/ai_54937451/), retrieved Aug. 5, 2009.

Cellular for Notebook PCs. CIO vol. 13, No. 1, Section 1, p. 90, Oct. 1, 1999.

"Briefs: Sierra Wireless . . . " NetworkWorld vol. 16, No. 34, p. 27, Aug. 23, 1999.

"Specification of the Bluetooth System, vol. 1." pp. 1-1080, Nov. 29, 1999.

"Specification of the Bluetooth System, vol. 2." pp. 1-438, Nov. 29, 1999.

"Digital Cellular Telecommunications System (Phase 2+); General Packet Radio Service (GPRS); Overall Description of the GPRS Radio Interface; Stage 2 (GSM 03.64 version 6.0.1 Release 1997)" pp. 1-56, Aug. 1998.

"Digital Cellular Telecommunications System (Phase 2+); General Packet Radio Service (GPRS); Overall Description of the GPRS Radio Interface; Stage 2 (GSM 03.64 version 6.1.0 Release 1997)" pp. 1-42, Oct. 1998.

"Digital Cellular Telecommunications System (Phase 2+); General Packet Radio Service (GPRS); Overall Description of the GPRS Radio Interface; Stage 2 (GSM 03.64 version 6.2.0 Release 1997)" pp. 1-42, May 1999.

"Digital Cellular Telecommunications System (Phase 2+); General Packet Radio Service (GPRS); Overall Description of the GPRS Radio Interface; Stage 2 (GSM 03.64 version 6.3.0 Release 1997)" pp. 1-42, Jul. 1999.

"Digital Cellular Telecommunications System (Phase 2+); General Packet Radio Service (GPRS); Overall Description of the GPRS Radio Interface; Stage 2 (GSM 03.64 version 7.0.0 Release 1997)" pp. 1-41, Jul. 1999.

Cai et al. "General Packet Radio Service in GSM." IEEE Communications Magazine, Oct. 1997, pp. 122-131.

"Part 11: Wireless LAN Medium Access Control (MAC) and Physical Layer (PHY) Specifications." IEEE Std 802.11-1997, pp. 1-445.

Lind et al. "The Network Vehicle—A Glimpse into the Future of Mobile Multi-Media." IEEE, pp. I21-1-I21-8, 1998.

Nokia Quick Guide, Accessories Guide, pp. 1-31, 1999.

Nokia 9110i User's Manual, pp. 1-190, 1999.

Qualcomm QCP—1960™, Sprint PCS User Guide, pp. 1-76, Apr. 1999.

Samsung Model SCH-3500, Sprint PCS User Guide, pp. 1-108, 1999.

StarTAC, Sprint PCS User Guide, pp. 1-118, Mar. 1999.

Visteon: for Your Listening Pleasure—Any Music, Any Time, Anywhere (http://www2.prnewswire.com/cgi-bin/stories.pl?ACCT=104&STORY=/www/story/01-05-2000/0001107812&DATE ), originally retrieved Jan. 5, 2000.

(56) References Cited

OTHER PUBLICATIONS

Pegoraro, "Music Factory; Retailers Struggle to Expand Listening Options Online." Contra Costa Times, Mar. 19, 2000 Sunday Final Edition, Business Section, p. H01.
EMusic.com Inc. Prospectus, Sep. 24, 1999, 85 pages.
Pegoraro, "Logging on; Setting Sound Free From the CD." The Washington Post, Mar. 3, 2000, Final Edition, Fast Forward Section, p. E01.
Knudsen, "MP3 Linux Players." Jul. 1, 1999, http://linuxjournal.com/article/3420, retrieved Jul. 16, 2010.
Jeffrey, "Net Music Firms to Tap Public Market." Billboard, Jul. 17, 1999, 2 pages.
"Digital Download Provider Muscimaker.com Partners With Download Directory Listen.com; Offers Nearly 100,000 Downloadable Tracks Via the Online Directory." PR Newswire, Financial News Section, Sep. 15, 1999, 3 pages.
"Myplay, Inc. Launches Consumer Online Music Service; First in Industry to Focus on Ability to Centrally Store Music and Access it Via Multiple Devices; Company Secures Funding from Noted Venture Capital Firms." PR Newswire, Entertainment, Television, and Culture Section, Oct. 13, 1999, 3 pages.
"Myplay.com Launches Today; New Online Service Makes Downloading Digital Music Easy for Everyone; Sign Up for Free Virtual Locker Get Bonus Tracks From Artists Including Kid Rock, Chris Rock, Buckcherry. Easy Access to Your Music Collection for Download to Portable Music Players." PR Newswire, Entertainment, Television, and Culture Section, Oct. 13, 1999, 2 pages.
RealJukebox Plus Manual, 1999, pp. 1-83.
RealPlayer™ Plus User Manual, 2000, pp. 1-118.
RealPlayer Plus™ G2 Manual, 1998, pp. 1-81.
SoundJam™ MP Digital Audio System User Guide, 1999, pp. 1-50.

* cited by examiner

MEDIA DEVICE WITH ENHANCED DATA RETRIEVAL FEATURE

REFERENCE TO RELATED APPLICATIONS

This application is related to the following: U.S. Patent Application Publication No. 2010/0076576, published on Mar. 25, 2010, and entitled "Systems, Methods, and Devices for Providing Broadcast Media from a Selected Source"; U.S. Patent Application Publication No. 2010/0075695, published on Mar. 25, 2010, and entitled "Systems, Methods, and Devices for Retrieving Local Broadcast Source Presets"; and U.S. Patent Application Publication No. 2010/0075616, published on Mar. 25, 2010, and entitled "Systems, Methods, and Devices for Associating a Contact Identifier with a Broadcast Source." The entire contents of the above-referenced application publications are incorporated herein by reference.

BACKGROUND

This invention relates to media devices having a broadcast radio receiver capable of receiving broadcast media along with broadcast media data and a transceiver capable of requesting and retrieving enhanced media data.

Traditional media devices, e.g., an MP3 player, typically connect with a headset to enable a user to listen to music. Other media devices may include a display that displays videos. Many types of media devices are portable and have compact form factors to enable efficient handling and use by a user. Certain media devices include a radio broadcast receiver capable of receiving amplitude modulated (AM), frequency modulated (FM), or satellite broadcast media. The media can typically include a song, video, news program, or radio show. Certain media devices, e.g., cellular telephones, include wireless transceivers capable of exchanging data with a public land mobile network (PLMN) or wireless data network that may be linked with the Internet or other data networks. Other media devices are capable of interfacing with personal area networks (PAN), wireless local area networks (WLAN), satellite data networks (SAN), and other data networks including, for example, Wi-fi (802.x) networks.

In addition to providing broadcast media (e.g., songs, video, television programs, and radio shows), certain broadcast media sources can supplement the broadcast media with broadcast media data. The broadcast media data can include media metadata (e.g., information about a particular song) or data about the broadcast source (e.g., the name of the broadcasting radio station).

The Radio Data System (RDS) is a communications standard developed by the European Broadcasting Union (EBU) that enables the transmission of small amounts of broadcast media data using FM radio broadcasts. RDS can send various types of broadcast media data including: time, track title, track artist, and station identification. RDS has been used in Europe and South America since the early 1990s.

The Radio Broadcast Data System (RBDS) is the name for the North American version of RDS, and is also often referred to simply as "RDS." The North American and European versions are nearly identical. Both RDS versions use a 57 kHz sub carrier to carry broadcast media data at 1187.5 bits per second.

One problem with using existing broadcast radio systems is that the broadcast media data is relatively small which limits the amount, quality, and types of media data that can practically be transmitted to a media device. For example, Radio Text (RT) provided by RDS is limited to 64-character text data. Thus, RT media data is typically limited to radio station slogans, song titles, or artist names. RDS cannot support the transmission of significantly larger amounts of enhanced media data for, for example, detailed graphics or video-based data. Accordingly, there is a need to enable a media device to retrieve significantly greater amounts of enhanced media data.

Another problem with existing broadcast radio systems is that the broadcast media data is not specific to a particular target media device. The broadcast provider provides the broadcast media data as, for example, RDS data that is available to all radio receivers. Unfortunately, different radio receivers or different media devices may have different capabilities or features. Also, the user of a particular media device may have a preference for a particular type of media data. Accordingly, there is a need to enable a media device to retrieve certain types of enhanced media data based on the media device's capabilities and/or user's preferences.

SUMMARY

The invention, in various embodiments, addresses deficiencies in the prior art by providing systems, methods and devices that enable a media device to retrieve enhanced media data based on broadcast media data received from a broadcast source.

In one aspect, a personal media device includes a broadcast receiver that receives broadcast media and broadcast media data from a broadcast source where the broadcast media data include a media identifier associated with the broadcast media. The personal media device includes a data transceiver that i) sends a retrieval request to a media server for enhanced media data where the retrieval request includes the media identifier and ii) receives the enhanced media data via a wireless data channel. The media device also includes a processor, in communication with the data transceiver, that performs a media device operation in response to the received enhanced media data.

The broadcast receiver may be a FM or AM radio receiver. The media may include a song or music. The broadcast media data may include RDS data. The RDS data may include the media identifier. The media identifier may include a track identifier. The track identifier may include a track title. The track identifier may include a numeric or alpha-numeric identifier. The track identifier may include a unique identifier.

The media may include, without limitation, a video, an image, audio, audio file, multimedia, movie, television data, satellite data, and any like broadcast data. The enhanced media data may include, without limitation, album art, an album image, an album video, song art, a song image, a song video, a ringtone, a ringtone offer, music, a music offer, artist information, artist concert information, artist trivia, song trivia, song-related information, broadcast source information, an advertisement, broadcast source contact information, promotional information, contact links to related information sources, and metadata associated with the media.

The media server may include, without limitation, a clearinghouse server and a broadcast source server. The clearinghouse server may include a database that stores the enhanced media data. The broadcast source server may include a database that stores the enhanced media data.

In one configuration, a media device operation includes, without limitation, displaying an image related to the track identifier, displaying a video related to the track identifier, displaying text related to the track identifier, displaying an advertisement, displaying a ringtone offer, displaying concert information, displaying a music offer, displaying album art, displaying metadata, and displaying a link to related information.

In another aspect, a clearinghouse system includes a data store for storing enhanced media data. The clearinghouse system includes a media server, in communications with the data store, that i) receives a retrieval request from a media device where the retrieval request includes a media identifier, ii) retrieves a portion of the enhanced media data from the data store where the portion of enhanced media data is associated with received media identifier, and iii) sends the portion of enhanced media data associated with the media identifier to the media device.

In a further aspect, an enhanced media data distribution system includes a clearinghouse server that i) assigns a unique media identifier to a media item, ii) stores enhanced media data associated with the media identifier, and iii) sends the enhanced media data to a media device in response to a retrieval request. The distribution system also includes a radio station server that receives the media identifier and a radio station transmitter that broadcasts the media item and associated media identifier.

In one configuration, the media device including a broadcast radio receiver that receives the media item and associated media identifier. The media device also includes a transceiver that sends a retrieval request including the media identifier to the clearinghouse server and receives the enhanced media data associated with the media identifier. The media device further includes a processor that performs a media device operation in response to the received enhanced media data.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DESCRIPTION OF THE INVENTION

Figure 1:
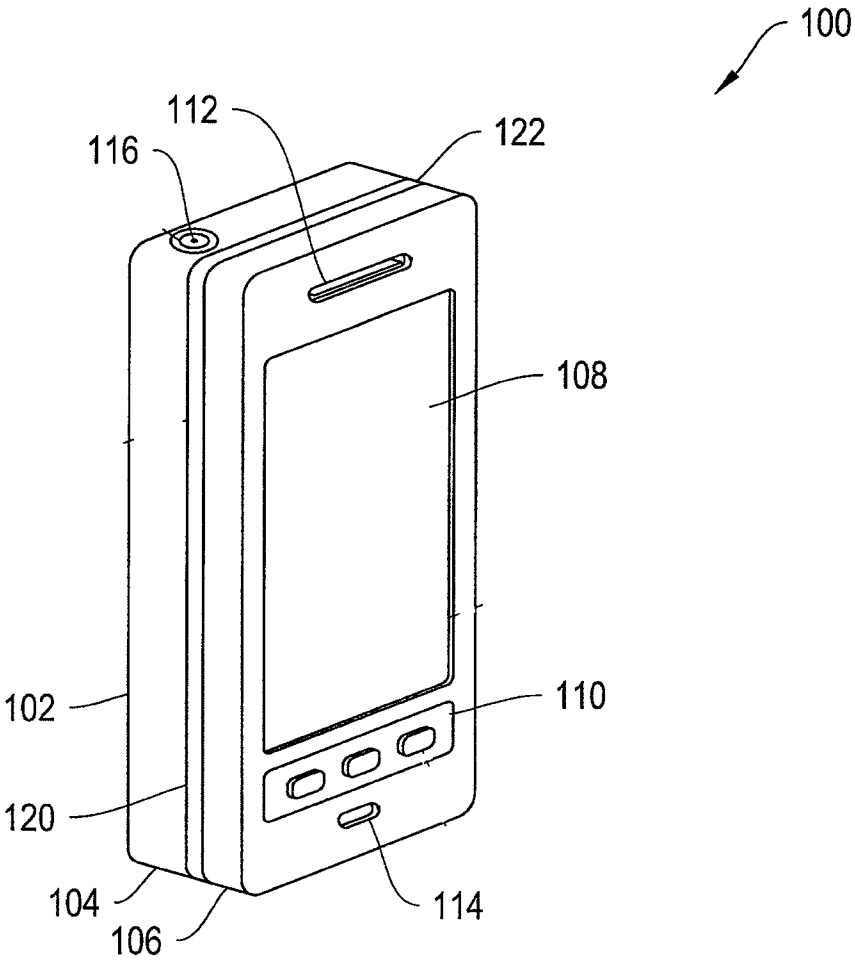
FIG. 1 is a perspective view of a media device according to an illustrative embodiment of the invention.

FIG. 1 is a perspective view of a media device 100 according to an illustrative embodiment of the invention. The device 100 includes a housing 102, a first housing portion 104, a second housing portion 106, a display 108, a keypad 110, a speaker housing aperture 112, a microphone housing aperture 114, a headphone jack 116, and frame sidewall 122. In certain embodiments, the frame sidewall 122 is the exposed portion of a frame residing within or adjacent to the housing 102 that provides structural support for the media device 100 and various internal components.

In one embodiment, the housing 102 includes a first housing portion 104 and a second housing portion 106 that are fastened together and/or to the frame sidewall 122 to encase various components of the media device 100. The housing 102 and its housing portions 104 and 106 may include polymer-based materials that are formed by, for example, injection molding to define the form factor of the media device 100. In one embodiment, the housing 102 surrounds and/or supports internal components such as, for example, a display 108, one or more circuit boards having integrated circuit components, internal radio frequency (RF) circuitry, an internal antenna, a speaker, a microphone, a hard drive, a processor, and other components. Further details regarding certain internal components are discussed herein with respect to FIG. 4. The housing 102 provides for mounting of a display 108, keypad 110, external jack 116, data connectors, or other external interface elements. The housing 102 may include one or more housing apertures 112 to facilitate delivery of sound, including voice and music, to a user from a speaker within the housing 102. The housing 102 may include one or more housing apertures 114 to facilitate the reception of sounds, such as voice, for an internal microphone from a device user.

Personal computing devices and/or media devices of this type may include a touchscreen control, such as a Pronto made available by Royal Philips Electronics of the Netherlands or a GPS receiver made available by Garmin International, Inc. of Olathe, Kans. In certain embodiments, the display 108 includes a graphical user interface (GUI) to enable a user to interact with the device 100. The personal computing device 100 may also include an image sensor such as a camera capable of capturing photographic images and/or video images.

Figure 2:
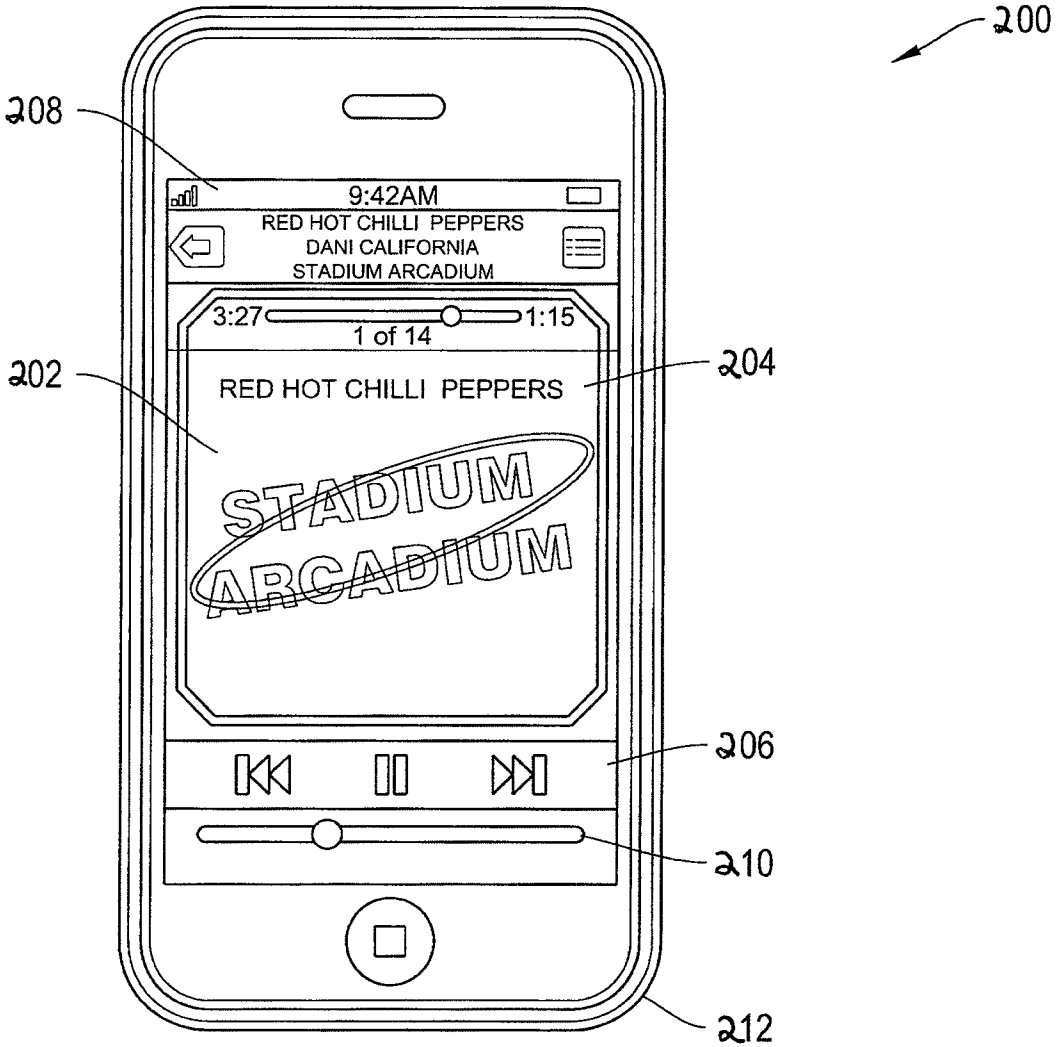
FIG. 2 is a view of a media device according to an illustrative embodiment of the invention.

FIG. 2 is a view of another personal media device 200 according to an illustrative embodiment of the invention. The media device 200 includes a display 202 showing a status bar 208 and video image 204, which may include, for example, a music video, a movie, video clip, or like video images. In one embodiment, a GUI of the display 202 includes an interface 206 that enables the media device 200 user to play, pause, fast forward, reverse, or monitor, via a slider 210, the progress of the video displayed on the display 202 or audio being played by the media device 200. The media device 200 includes a housing base 212.

Figure 3:
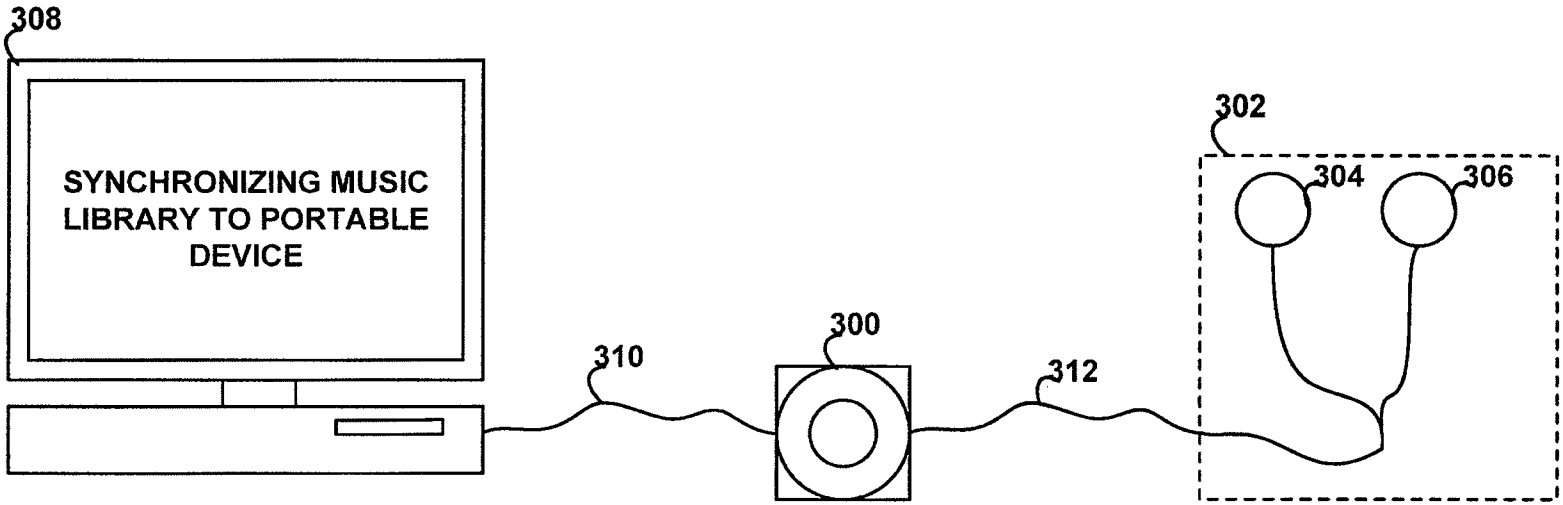
FIG. 3 is a communications topology including a media device according to an illustrative embodiment of the invention.

FIG. 3 shows a communications topology including a computer 308, media device 300, and a headset 302. Media device 300 may communicate with computer 308 via communications channel 310. Media device 300 may communicate with the headset 302 via communications channel 312. In one embodiment, communications channel 312 is a wired communication channel. Alternatively, the communications channel 312 may be wireless.

Media device 300 may take any form. For example, media device 300 may be a portable media player such as a portable music player. Media device 300 may also include, for example, a mobile telephone that may play downloaded media. Media may be downloaded directly to the media device 300 or may be downloaded to computer 308 and transferred to the media device 300 via communications channel 310.

The media device 300 may include a wireless communications device such as a cellular telephone, satellite telephone, cordless telephone, personal digital assistant (PDA), pager, portable computer, or any other device capable of wireless communications. In fact, FIG. 2 shows an exemplary cellular telephone version of a broad category of media device 300. The media device 300 may be compact, portable, mobile, personal, and/or transportable.

The media device 300 may also be integrated within the packaging of other devices or structures such as a vehicle, video game system, appliance, clothing, helmet, glasses, wearable apparel, stereo system, computer system, entertainment system, or other portable devices. In certain embodiments, the media device 300 may be docked or connected to a wireless (e.g., a wi-fi docking system)and/or radio enabling accessory system (e.g., AM/FM or satellite radio receiver) that provides the media device 300 with short-range communicating functionality and/or radio reception capability. Alternative types of media devices 300 may include, for example, a media player such as an iPod®, iPod® Nano, iPod® Shuffle, or Apple® iphone available by Apple Inc., of Cupertino, Calif., pocket-sized personal computers such as an iPAQ® Pocket PC available by Hewlett Packard Inc., of Palo Alto, Calif. and any other device capable of communicating wirelessly (with or without the aid of a wireless enabling accessory system).

In certain embodiments, the media device 300 may synchronize with, for example, a remote computing system or server, e.g., computer 308, to receive media (using either wireless or wireline communications paths). Wireless syncing enables the media device 300 to transmit and receive media and data without requiring a wired connection. Media may include, without limitation, sound or audio files, music, video, multi-media, and digital data, in streaming and/or discrete (e.g., files and packets) formats.

During synchronization, a host system, e.g., device 308, may provide media to a client system or software application embedded within the media device 300. In certain embodiments, media and/or data is "downloaded" to the media device 300. In other embodiments, the media device 300 is capable of uploading media to a remote host or other client system.

The headset 302 may be utilized to provide an audio functionality associated with media device 300. The headset 302 may include speakers 304 and 306 as well as a microphone.

Figure 4:
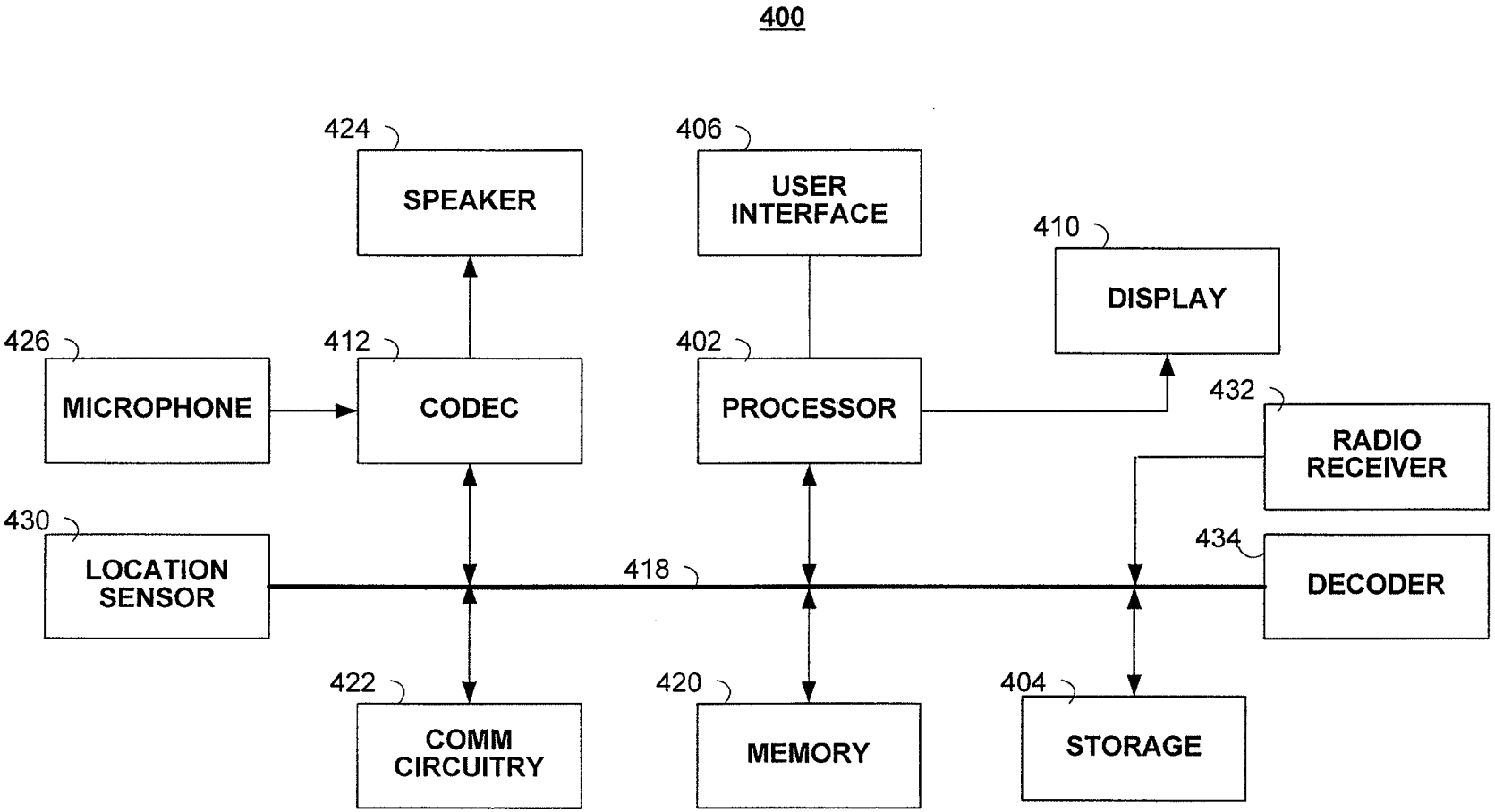
FIG. 4 shows a simplified functional block diagram of a media device according to an illustrative embodiment of the invention.

FIG. 4 shows a simplified functional block diagram of a media device 400 according to an illustrative embodiment of the invention. The block diagram provides a generalized block diagram of a computer system such as may be employed, without limitation, by the media devices 100, 200, and 300. The media device 400 may include a processor 402, storage device 404, user interface 406, display 410, CODEC 412, bus 418, memory 420, communications circuitry 422, a speaker or transducer 424, a microphone 426, a location sensor 430, a radio receiver 432, a radio receiver decoder 434, a speaker 424, and communications circuitry to facilitate communications with a headset 302, other media device, or other system via a communications network. Processor 402 may control the operation of many functions and other circuitry included in media device 400. Processor 402 may drive display 410 and may receive user inputs from the user interface 406.

Storage device 404 may store media (e.g., music and video files), software (e.g., for implanting functions on device 400), preference information (e.g., media playback preferences), lifestyle information (e.g., food preferences), personal information (e.g., information obtained by exercise monitoring equipment), transaction information (e.g., information such as credit card information), word processing information, personal productivity information, wireless connection information (e.g., information that may enable media device to establish wireless communication with another device), subscription information (e.g., information that keeps tracks of podcasts or television shows or other media that a user subscribes to), radio station broadcast source information, and any other suitable data. Storage device 404 may include one more storage mediums, including for example, a hard-drive, permanent memory such as ROM, semi-permanent memory such as RAM, or cache.

Memory 420 may include one or more different types of memory which may be used for performing device functions. For example, memory 420 may include cache, ROM, and/or RAM. Bus 418 may provide a data transfer path for transferring data to, from, or between at least storage device 404, memory 420, and processor 402. Coder/decoder (CODEC) 412 may be included to convert digital audio signals into an analog signals for driving the speaker 424 to produce sound including voice, music, and other like audio. The CODEC 412 may also convert audio inputs from the microphone 426 into digital audio signals. The CODEC 412 may include a video CODEC for processing digital and/or analog video signals.

User interface 406 may allow a user to interact with the media device 400. For example, the user interface 406 can take a variety of forms, such as a button, keypad, dial, a click wheel, or a touch screen. Communications circuitry 422 may include circuitry for wireless communication (e.g., short-range and/or long range communication). For example, the wireless communication circuitry may be Wi-Fi enabling circuitry that permits wireless communication according to one of the 802.1x standards. Other wireless network protocol standards could also be used, either in alternative to the identified protocols or in addition to the identified protocols.

Other network standards may include Bluetooth, the Global System for Mobile Communications (GSM), code division multiple access (CDMA), and long-term evolution (LTE) based wireless protocols. Communications circuitry 422 may also include circuitry that enables the media device 400 to be electrically coupled to another device (e.g., a computer or an accessory device) and communicate with that other device.

In one embodiment, the media device 400 may be a portable computing device dedicated to processing media such as audio and video. For example, the media device 400 may be a media device such as media player (e.g., MP3 player), a game player, a remote controller, a portable communication device, a remote ordering interface, an audio tour player, or other suitable media device. The media device 400 may be battery-operated and highly portable so as to allow a user to listen to music, play games or video, record video or take pictures, communicate with others, and/or control other devices. In addition, the media device 400 may be sized such that it fits relatively easily into a pocket or hand of the user. By being handheld, the media device 400 (or media devices 100, 200, and 300) is relatively small and easily handled and utilized by its user and thus may be taken practically anywhere the user travels.

The media device 400 may employ a location sensor 430 to enable the media device to determine its geographic location in support of location-based services and other services. The location sensor 430 may include a global position system (GPS) receiver. The location sensor 430 may include one or more radio receivers that perform radio doppler and/or triangulation sensing to determine the media device 400 location. In certain embodiments, the location sensor 430 may be integrated with the communications circuitry 422. In one embodiment, the location sensor 430 may include a data decoder such as decoder 434 that decodes a source identifier broadcast by a radio source (e.g., radio station identifier or cellular network system identifier (SID)).

Figure 5:
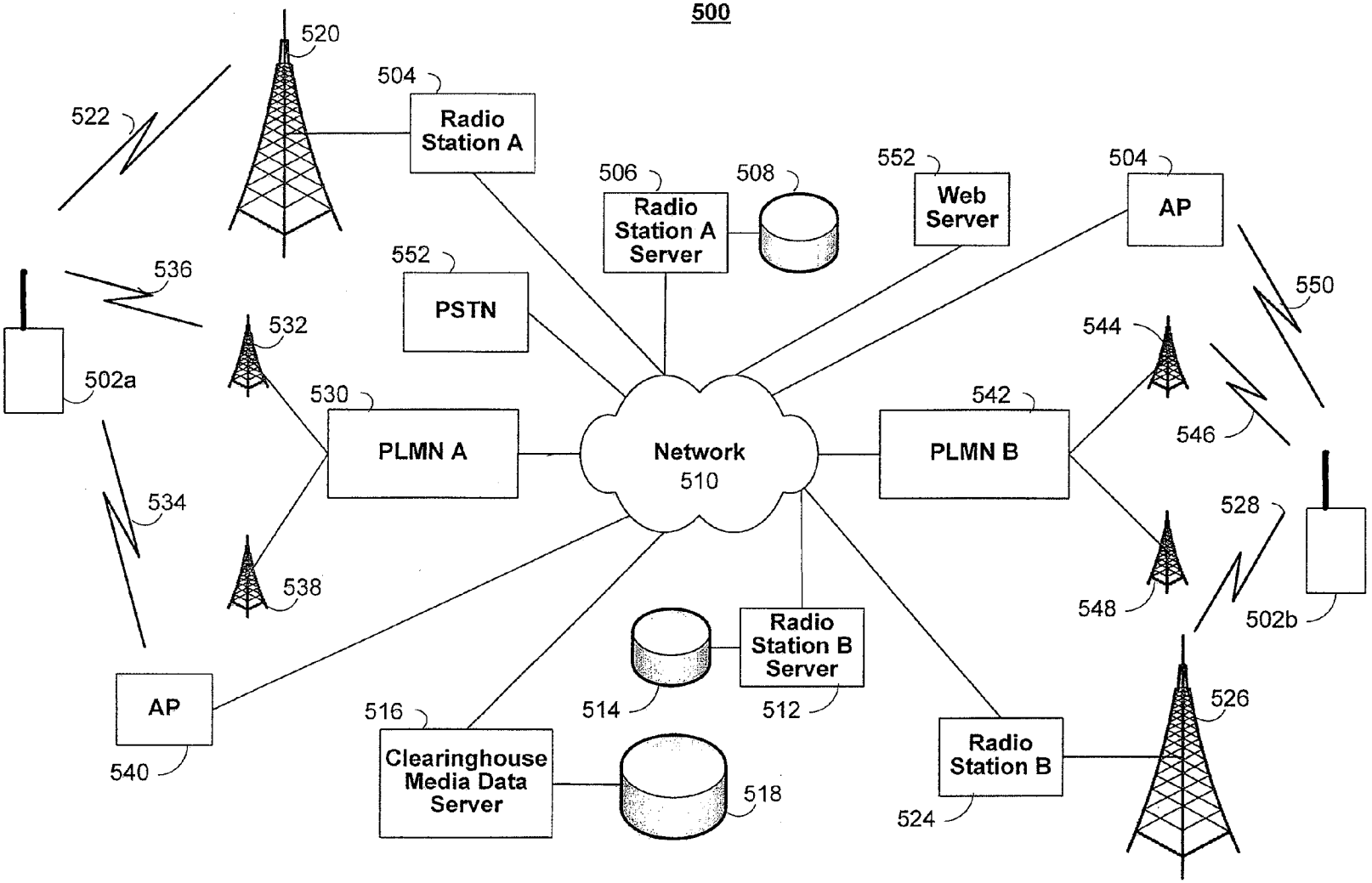
FIG. 5 shows a diagram of a distribution system for media and media data according to an illustrative embodiment of the invention.

FIG. 5 shows a diagram of a media distribution system 500 according to an illustrative embodiment of the invention. The media distribution system 500 includes a media device 502, a broadcast radio station 504, a broadcast radio station 524, a public land mobile network (PLMN) 530, a PLMN 542, an access point (AP) 540, and AP 504, a data network 510, a public switched telephone network (PSTN) 552, and a clearinghouse server 516. The network 510 may include the Internet. The radio station 504 may include a radio station tower 520 that facilitates the broadcast of a broadcast radio signal 522 to a plurality of media devices including media device 502. Also, the radio station 524 may include a radio station tower 526 that facilitates the broadcast of a broadcast radio signal 528 to a plurality of media devices including media device 502.

The broadcast radio signal may be, without limitation, frequency modulated (FM) or amplitude modulated (AM). The interfaces 522 and 528 may operate in an AM frequency band of about 500-1500kHz. The interfaces 522 and 528 may operate in an FM and/or television frequency band of about 54-1600 MHz. The interfaces 522 and 528 may operate in any number of frequency bands such as, for example, a satellite frequency band. The radio station 504 may be associated with a radio station server 506 that includes a database 508 for storing media and/or media data. The radio station 524 may be associated with a radio station serve 512 that includes a database 514 for storing media and/or media data.

The PLMNs 530 and 542 may include a cellular telephone network. The PLMNs 530 and 542 may utilize a plurality of cellular radio towers 532, 538, 544, and 548 respectively. The media device 502 may exchange data and other communications with the PLMN 530 and/or 542 via a wireless communications channel 536 and/or 546 respectively. The media device 502 may exchange data and other communications with the AP 540 and/or AP 504 via a wireless communications channel 534 and 550 respectively. The clearinghouse media data server 516 may include a database 518 for storing media and/or media data.

Figure 6:
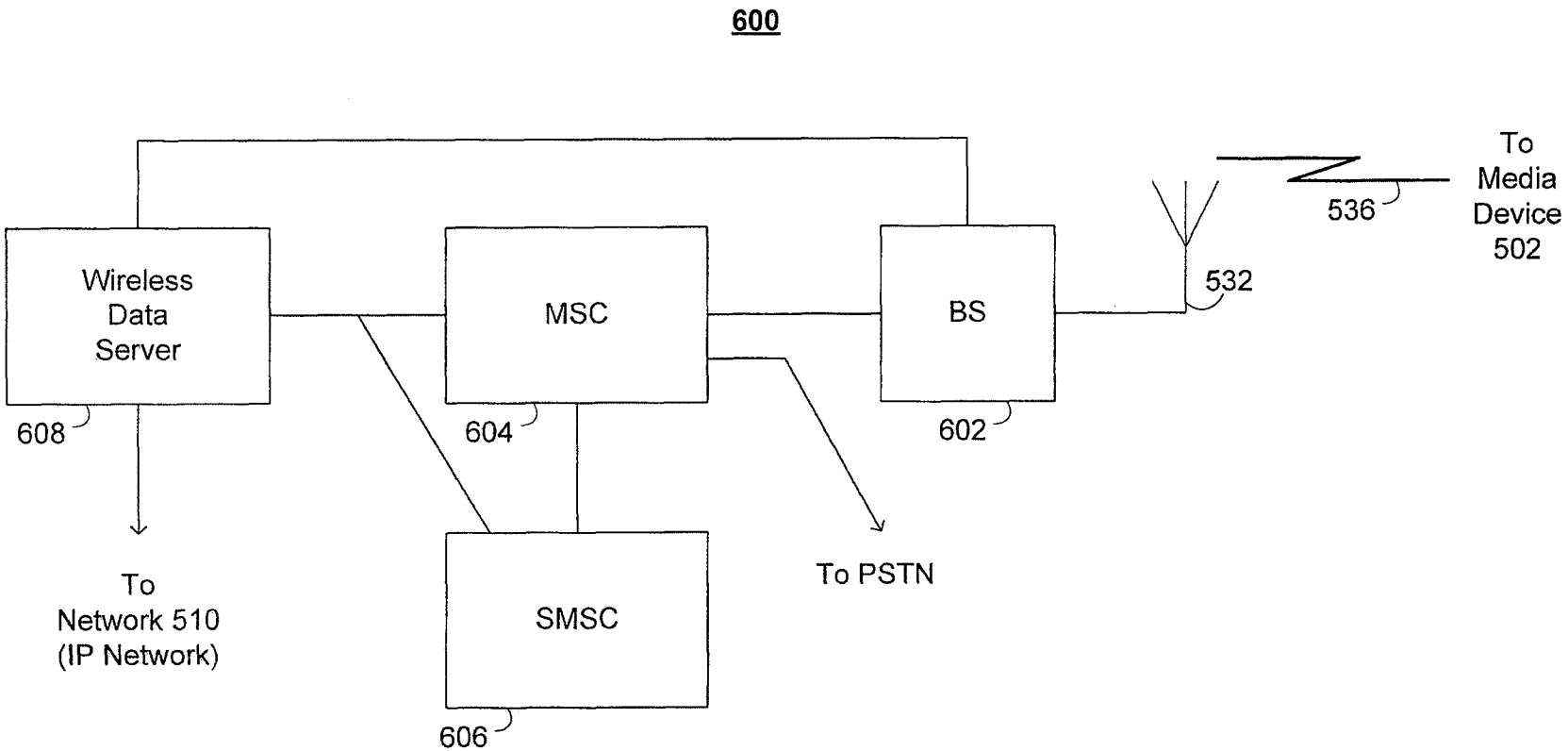
FIG. 6 shows a diagram of a public land mobile network (PLMN) data distribution system according to an illustrative embodiment of the invention.

FIG. 6 shows a diagram of a public land mobile network (PLMN) 600 according to an illustrative embodiment of the invention. A PLMN may include a wireless telecommunications network and/or a cellular telephone network such as a Global System for Mobile communications (GSM), cdma2000 system, ANSI-136 TDMA system, LTE, and like wireless communications networks. These networks may also provide data communications services such as Evolution-data only (EV-DO), General Packet Radio Service (GPRS), wireless application protocol (WAP), cellular digital packet data (CDPD), and like wireless data services.

PLMN networks are generally referred to as cellular networks because they employ a frequency re-use architecture in which wireless access channels are grouped into geographically-located cells and sectors. The size of each cell depends on the output power of the network base station (BS) transceiver, e.g., BS 602, associated with each cellular tower 532 and cell. Each access channel uses a certain frequency band in one geographic cell that is re-used in another cell, geographically separated from the first cell, by another access channel where the likelihood of interference is minimized.

These networks also use a centralized switch or server such as the mobile switching center (MSC) 604 to enable a wireless device to move from cell to cell while maintaining a persistent data connection. In the United States, cellular and Personal Communications Service (PCS) networks operate in the licensed commercial 800-900 Mhz and 1900-2100 Mhz ranges. Access data channels, however, may be bandwidth limited to 30 khz, 200 khz, or 1.24 Mhz depending on the wireless air interface standard used.

PLMN networks primarily provide voice communications while also providing relatively low rate data communications (e.g., 9.6-140 kbps). PLMN networks such as the Global System for Mobile Communications (GSM) and cdma2000 provide a Short Message Service (SMS) that enables telephone users to send relatively short, e.g., about 160 bytes, messages to other cellular telephones or to traditional electronic mail (e-mail) accounts within land-based IP networks.

A Short Message Server Center (SMSC) 606 typically coordinates with the MSC 604 to distribute SMS messages to cellular telephones and/or media devices 502. The SMSC may also interface with a wireless data server 608 to send SMS messages with destination addresses, e.g., e-mail addresses, external to the PLMN 600. The SMSC may include a mail server and/or other functionality to convert SMS messages to the proper e-mail format if necessary. Alternatively, the wireless data server may include a mail server such as a POP and/or Exchange server to facilitate the delivery of e-mail messages to and from the PLMN 600.

SMS messages may be transmitted over the air interface 120 via the traffic and/or control channels of the PLMN 600 network. While SMS messages are typically limited to about 160 bytes in length, longer text messages may be sent to or received by a media device 502. This may be performed by breaking a larger message into multiple SMS messages for delivery and then re-assembling the multiple SMS messages into the original message upon receipt. Multimedia message services (MMS) may also be employed having messages that include text, video, pictures, and audio.

Recently, PLMN providers have launched higher bandwidth data networks such as cdma2000 Evolution Data Only (EVDO) networks that provide up to 2 Mbps and Third Generation GSM (3GSM) networks that provide approximately 300 kbps data rates. These higher rate data services may employ point-to-point (PPP), simple IP and/or mobile IP (MIP) protocols to more efficiently interface with traditional IP networks such as network 510 and/or the Internet. The wireless data server 608 may function as a cdma2000 and/or GPRS Packet Data Server Node (PDSN), MIP Home Agent, MIP Foreign agent, wireless data gateway, and like systems to facilitate data communications with an external data network such as the network 510.

Using circuit-switched and/or packet-switched data services, the PLMN 600, 530, and 542 enable a media device 502 to act like a network interface to another data network such as the Internet. Thus, media device 502 may employ any of the applications and features of a standard workstation and/or home personal computer, subject to the processing speed, power, and memory constraints of a compact and mobile device. For example, the media device 502 may utilize a WWW browser employing HTML, WML, XML, and like markup languages to facilitate access to a remote web server, e.g., server 552, 506, 512, and/or 516, via the network 510. The media device 502 may utilize certain applications that enable the exchange of data with remote data servers connected to the network 510. Data may be transported to and from the network 510 via the wireless data server 608. In these instances, the wireless data server 608 exchanges data with the BS 602. The BS 602, in turn, transmits data to and/or receives data from the media device 502 via one or more data traffic channels on the air interface 536 or 546.

Figure 7:
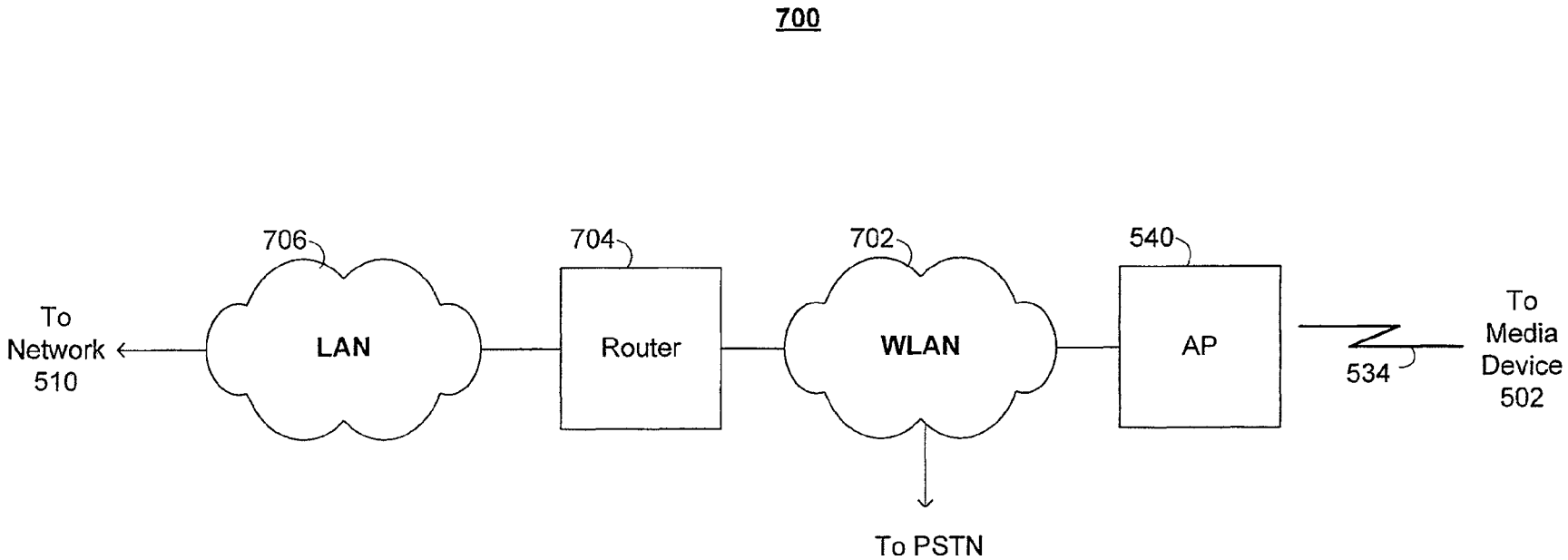
FIG. 7 shows a diagram of a wireless access network including an access point according to an illustrative embodiment of the invention.

FIG. 7 shows a diagram of a wireless access network 700 including an access point (AP) 540 according to an illustrative embodiment of the invention. A wireless access network may include any wireless network that facilitates communications from one communications device to another or to another network such as the Internet. Typical wireless access networks include 802.11, WiFi, WiMAX, Bluetooth, proprietary wireless LANs, wide area wireless networks, and like wireless access networks.

The wireless access network 700 includes an AP 540, a wireless LAN (WLAN) 702, router 704, and local area network (LAN) 706. The LAN may be connected to network 510 via one or more data networks. The WLAN 702 may be connected to the PSTN 552 via one or more network interfaces. The AP 540 may connect with one or more media devices 502. WLAN networks, such as WLAN 702, employ wireless APs 540 to communicate with multiple wireless devices, e.g., media device 502, simultaneously via a set of wireless access channels.

While the wireless access network 700 may not support SMS messaging as with the PLMN 600, the wireless access network 700 is capable of supporting relatively high data rate communications between a media device 502 and the network 510. Furthermore, the wireless access network 700 can support higher layer protocols such as TCP/IP, HTTP, and UDP, which enable the use of a web browser and other applications at the media device 502.

Returning to FIG. 5, in operation, the media device 502 may move from one geographic location in the vicinity of certain wireless communications infrastructure elements to another geographic location in the vicinity of other wireless communications infrastructure elements. For example, FIG. 5 refers to media device 502 as media device 502*a* while the device is in the vicinity of radio station 504, but then refers to media device 502 as media device 502*b* when the device is in the vicinity of radio station 524. In other embodiments, the terms 502*a* and 502*b* can refer to different media devices.

As discussed previously, a media device 502 may include a broadcast radio receiver, e.g., radio receiver 432, that enables the media device 502 to receive media from a plurality of radio stations, e.g., radio station 504, within its vicinity. The media device 502 may include the capability to enable a user to configure a set of favorite radio stations and/or radio station frequencies so that the user can conveniently tune the broadcast radio receiver 432 to a favorite radio station.

In addition to the radio receiver 432, the media device 502 may include a data transceiver as part of its communications circuitry 422 to facilitate the exchange of data with a PLMN, e.g., PLMN 530, a wireless access network, e.g., via AP 540, or another like wireless data network. In certain embodiments, the media device 502 may utilize a data transceiver to supplement broadcast media and/or media data received from a radio station such as radio stations 504 and 524. In one embodiment, the media device 502 is capable of querying a clearinghouse media data server 516 via a wireless data network (e.g., PLMN or wireless access network) to obtain media and/or media data. A clearinghouse server 516 may include one or more data servers and systems that perform network-based services via, for example, the Internet. One example of a clearinghouse media data server 512 is the iTunes® music downloading service, made available by Apple Inc. of Cupertino, Calif. Media data may include metadata and/or data about or related to media. For example, media data may include an image such as album cover art related to a song. Media data may also include information related to a broadcast source of the media such as the name of a radio station playing a song. In certain embodiments, the media device 502 can retrieve media and/or media data from a radio station server 504 and/or its associated database 508, the clearinghouse server 516 and/or its associated database 518, a remote web server 552, and any other data source in communication with the network 510.

One problem with existing broadcast radio receivers is that the amount of media data broadcast along with the media is relatively limited in size, flexibility, and scope. For example, the RDS system provides a limited amount of information such as a song title, artist name, 64-character text, a station call sign, and other information. However, the available bandwidth is so limited as to prevent the distribution of much richer media data including, for example, a graphic image of album cover art related to a song. The present invention advantageously addresses this problem by enabling a media device 502 to access a data network to supplement the limited broadcast media data and/or obtain enhanced media data associated with the media being broadcast by a broadcast radio source.

Figure 8:
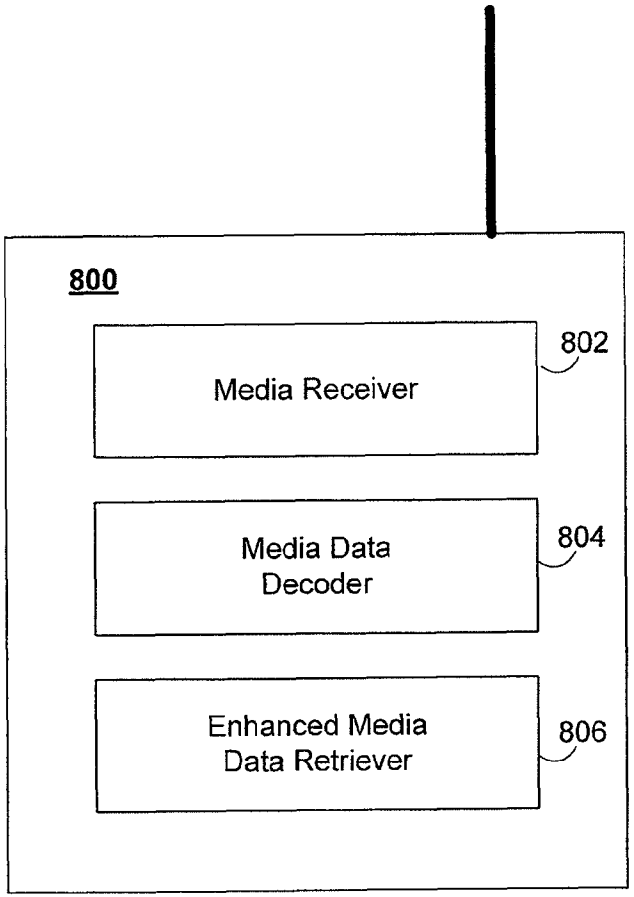
FIG. 8 is a diagram of a computer processing environment including various applications or routines running within a media device according to an illustrative embodiment of the invention.

FIG. 8 is a diagram of a computer processing environment including various applications or routines running within a media device 800 according to an illustrative embodiment of the invention. The media device 800 includes a media receiver application 802, a media data decoder application 804, and an enhanced media data retriever application 806. The media receiver application 802 may control the operation of various hardware and/or software functions to enable the reception of broadcast media from a broadcast radio source such as radio station 504. The media data decoder application 804 may control the operation of various hardware and/or software functions to enable the media device 800 to decode various media data, e.g., RDS data, received from a broadcast radio source. The enhanced media data retriever application 806 may control the operation of various hardware and/or software functions to enable the media device 800 to retrieve enhanced media data via one or more wireless data networks in communication with the media device 800.

The media device 800 may access one or more remote databases such as, without limitation, databases 508, 514, and 518, or other data sources such as server 552, to retrieve the enhanced media data. In certain embodiments, the broadcast media data may include a media identifier associated with a particular media item such as a song. The media identifier may include a unique identifier. The unique identifier may be numeric and/or alpha-numeric. The media identifier may include a track identifier. By employing a media identifier, the media device 800 may query a remote server and/or database to efficiently retrieve enhanced media data that is associated with the media identified by the media identifier.

Figure 9:
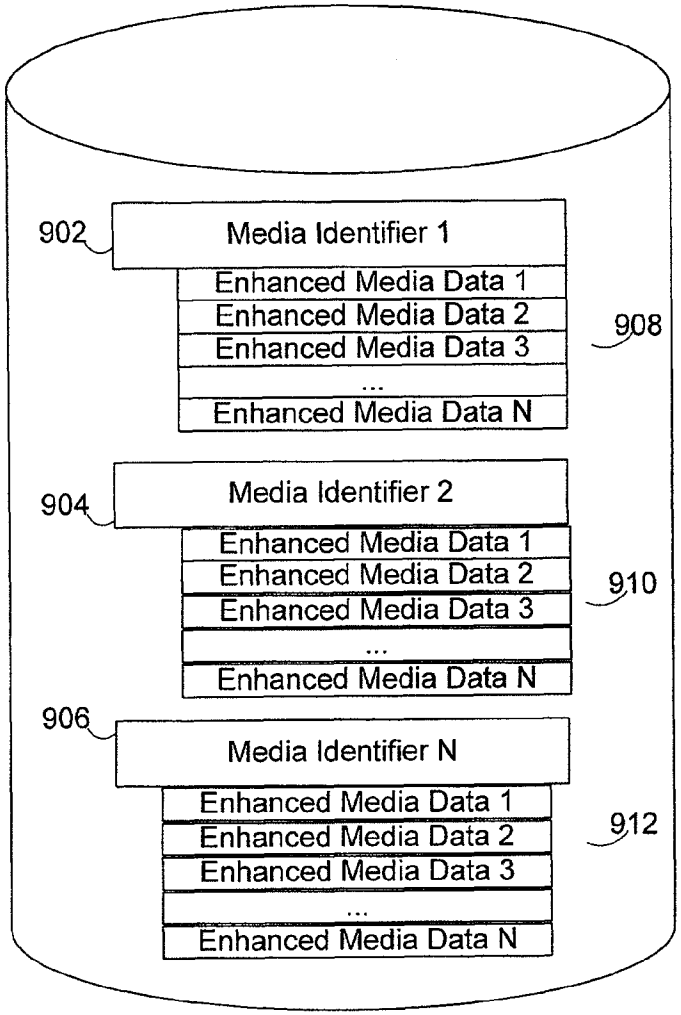
FIG. 9 includes a database and/or list associating media identifiers with enhanced media data according to an illustrative embodiment of the invention.

FIG. 9 includes a database 900 and/or list associating media identifiers 902, 904, and 906 with enhanced media data 908 according to an illustrative embodiment of the invention. The enhanced media data may include, without limitation, album art, an album image, an album video, song art, a song image, a song video, a ringtone, a ringtone offer, music, a music offer, artist information, artist concert information, artist trivia, song trivia, song-related information, broadcast source information, an advertisement, broadcast source contact information, promotional information, contact links to related information sources, metadata associated with a media item, and any like information related to the media. The database 900 may be associated with the clearinghouse server 516 and/or located at database 518. The database 900 may be associated with a radio station server 506 and/or 512, and located at database 508 and databases 514 respectively. The database 900 may be located at any remote source such as web server 552. The database 900 may be a virtual and/or distributed database such that portions of the database are located at databases 518, 508, 514, and other remote data sources.

Figure 10:
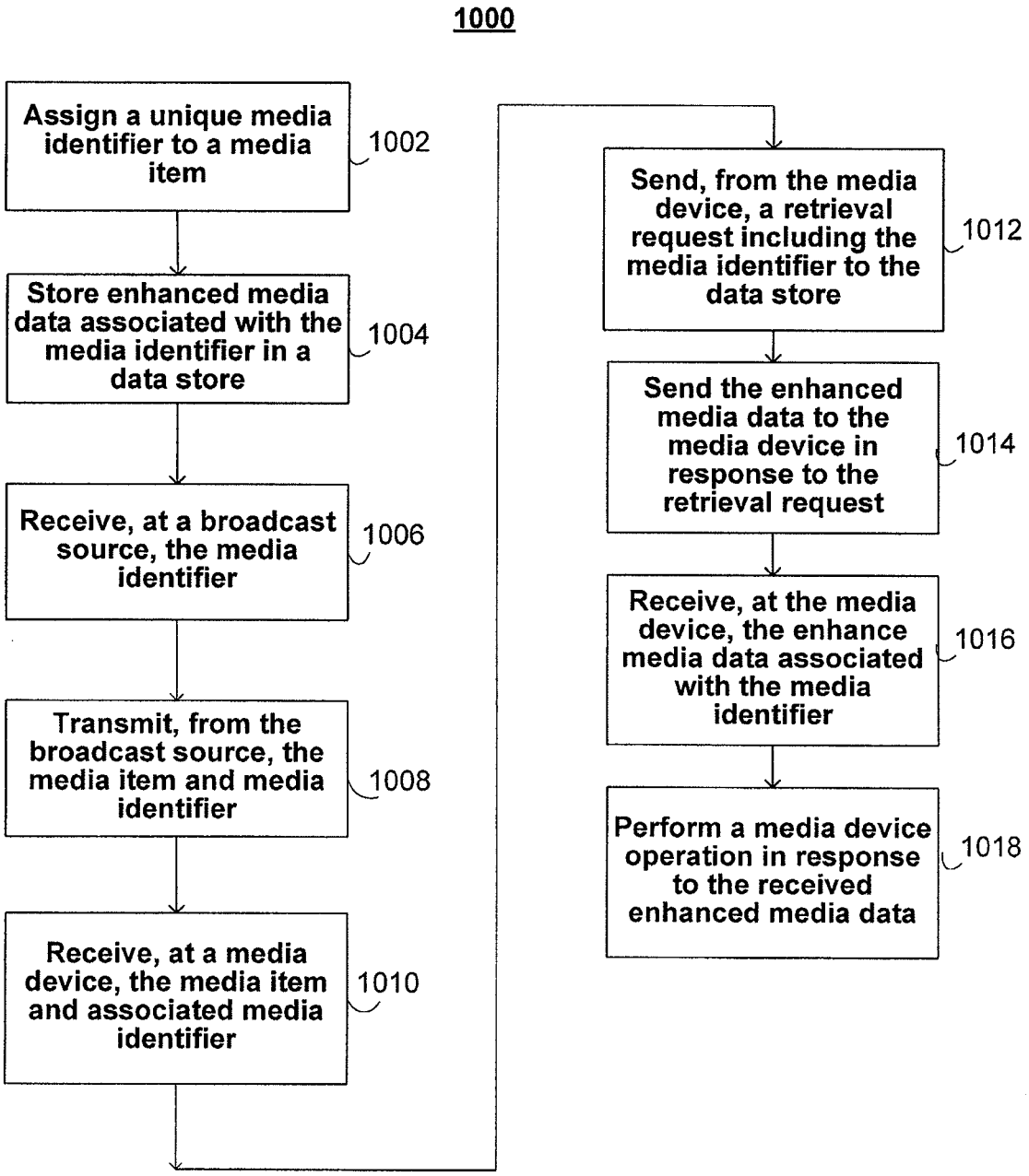
FIG. 10 is a flow diagram of a process for distributing enhanced media data to a media device according to an illustrative embodiment of the invention.

FIG. 10 is a flow diagram of a process 1000 for distributing enhanced media data 908 according to an illustrative embodiment of the invention. First, a media server 516 assigns a unique media identifier 902 to a media item such as a song (Step 1002). Then, the media server 516 stores enhanced media data 908 associated with the media identifier 902 in a data store such as database 900 (or database 518, 508, or 514) (Step 1004). A broadcast source such as radio station 504 receives the media identifier 902 via a network 510 which may include the Internet (Step 1006). The broadcast source, e.g., radio station 504, transmits and/or broadcasts the media item and associated media identifier 902 via wireless interface 522 (Step 1008). A media device 502 receives the media item and associated media identifier 902 (Step 1010). Then, the media device 502 sends a retrieval request including the media identifier 902 to the data store such as clearinghouse sever 516 and/or database 518 (Step 1012). The retrieval request may also include media device type information and/or user preference information. The data store may determine the types or categories of enhanced media data that should be sent to the media device based on the device type or user preference information. The data store then sends the enhanced media data 908 to the media device 502 in response to the retrieval request (Step 1014). The media device 502 receives the enhanced media data 908 associated with the media identifier 902 (Step 1016). Then, the media device 502 performs an operation in response to the received enhanced media data 908 (Step 1018). Media device type information may include feature information about the media device such as, without limitation, processor type, display type, memory size, user interface type, audio features, video features, device purpose, and the like. User preference information may include, without limitation, preferred types of enhanced media data (e.g., concert schedules, album art, links to other source), preferred formats (audio, visual, multimedia, textual), preferred amounts of enhanced media data, and the like.

Persons skilled in the art will appreciate that the various configurations described herein may be combined without departing from the present invention. It will also be recognized that the invention may take many forms other than those disclosed in this specification. Accordingly, it is emphasized that the invention is not limited to the disclosed methods, systems and apparatuses, but is intended to include variations to and modifications thereof which are within the spirit of the following claims.

What is claimed is:

1. A media device comprising:

a broadcast receiver for receiving broadcast media and broadcast media data from a broadcast source, the broadcast media data comprising a media identifier associated with the broadcast media;

a data transceiver for sending a retrieval request to a media server for enhanced media data, wherein the enhanced media data is only meta-data, wherein the meta-data is related to the broadcast media, and wherein the enhanced media data is transmitted from the media server, the retrieval request comprising the media identifier and media device type information, and the data transceiver receiving the enhanced media data via a wireless data channel, wherein the received enhanced media data is based on the sent media identifier and the sent media device type information; and a processor in communication with the data transceiver for performing a media device operation in response to the receipt of the enhanced media data.

2. The device of claim 1, wherein the broadcast receiver comprises at least one of a FM radio receiver or an AM radio receiver.

3. The device of claim 2, wherein the received broadcast media comprises at least one of a song or music.

4. The device of claim 3, wherein the received broadcast media data comprises at least one of Radio Broadcast Data System (RBDS) data or Radio Data System (RDS) data.

5. The device of claim 4, wherein the RDS data comprises the media identifier.

6. The device of claim 5, wherein the media identifier comprises a track identifier.

7. The device of claim 6, wherein the track identifier comprises a track title.

8. The device of claim 6, wherein the track identifier comprises at least one of a numeric or alpha-numeric identifier.

9. The device of claim 8, wherein the track identifier comprises a unique identifier.

10. The device of claim 1, wherein the broadcast media comprises at least one of a video, an image, audio, an audio file, multimedia, a movie, or television data.

11. The device of claim 1, wherein the broadcast source is the media server.

12. The device of claim 1, wherein the media device type information comprises at least one of processor type, display type, memory size, user interface type, audio features, video features, or device purpose of the media device.

13. A method for sending enhanced media data to a media device, the method comprising:

broadcasting media and media data from a broadcast source, the broadcast media data comprising a media identifier associated with the broadcast media;

receiving, at a media server, a retrieval request comprising the media identifier and media device type information for enhanced media data from the media device, wherein the enhanced media data is only meta-data, wherein the meta-data is related to the broadcast media, and wherein the enhanced media data is transmitted from the media server;

retrieving, at the media server, the enhanced media data from a data store based on the media identifier and the media device type information, and sending the enhanced media data to the media device at least partially via a wireless data channel to enable the media device to perform an operation based on the enhanced media data.

14. The device of claim 1, wherein:

the first data type comprises at least one of image data, video data, or advertisement data; and the second data type comprises audio data.

15. The method of claim 13, wherein the media device type information comprises at least one of processor type, display type, memory size, user interface type, audio features, video features, or device purpose of the media device.

16. The method of claim 13, wherein the broadcasting is via at least one of a FM radio channel or an AM radio channel.

17. The method of claim 13, wherein the broadcast media comprises at least one of a video, an image, audio, an audio file, multimedia, a movie, or television data.

18. The method of claim 13, wherein the media server comprises at least one of a clearinghouse server or a broadcast source server.

19. The method of claim 18, wherein the clearinghouse server comprises a database storing the enhanced media data.

20. The method of claim 13, wherein the broadcast source comprises a database storing the enhanced media data.

21. The method of claim 13, wherein:

the first data type comprises at least one of image data, video data, or advertisement data; and the second data type comprises audio data.

22. A clearinghouse system comprising:

a data store for storing enhanced media data, wherein the enhanced media data is only meta-data, wherein the meta-data is related to a broadcast media, the meta-data to be provided to a media device upon request by the media device;

a media server, in communications with the data store, for receiving a retrieval request of the enhanced media data from the media device, the enhanced media data transmitted to the media device from the media server, the retrieval request including a media identifier and at least one of media device type information about the media device and user preference information, the media server retrieving a portion of the stored enhanced media data, the portion being associated with the media identifier and the at least one of the media device type information and the user preference information, and the media server sending the retrieved portion of the stored enhanced media data.

23. The system of claim 22, wherein the media server comprises at least one of a clearinghouse server or a broadcast source server.

24. The system of claim 22, wherein the data store comprises at least one database associated with the media server.

25. The system of claim 22, wherein the media identifier comprises at least one of a broadcast source identifier, a track identifier, or an artist identifier.

26. The system of claim 25, wherein the track identifier comprises a unique identifier.

27. The clearinghouse system of claim 22, wherein the at least one of the media device type information and the user preference information comprises at least one of processor type, display type, memory size, user interface type, audio features, video features, or device purpose of the media device.

28. The clearinghouse system of claim 22, wherein the at least one of the media device type information and the user preference information comprises at least one of a preferred type of enhanced media data, a preferred format of enhanced media data, or a preferred amount of enhanced media data.

29. The system of claim 22, wherein:

the first data type comprises audio data; and the second data type comprises at least one of image data, video data, or advertisement data.

30. An enhanced media data distribution system comprising:

a clearinghouse server for assigning a unique media identifier to a media item, the clearinghouse server storing enhanced media data associated with the unique media identifier wherein the enhanced media data is only meta-data, wherein the meta-data is related to the broadcast media, and wherein the enhanced media data is transmitted from the clearinghouse server, the clearing house server receiving, from a media device, a retrieval request comprising the unique media identifier and information regarding at least one enhanced media data preference of a user of the media device, and the clearinghouse server sending at least a portion of the enhanced media data to the media device in response to the retrieval request;

a radio station server for receiving the unique media identifier; and a radio station transmitter for broadcasting the media item and the unique media identifier;

wherein the media device comprises:

a broadcast radio receiver for receiving the broadcast media item and the unique media identifier, a transceiver for i) sending the retrieval request including the unique media identifier and the information to the clearinghouse server and ii) receiving the at least a portion of the enhanced media data, and a processor for performing a media device operation in response to the received at least a portion of the enhanced media data.

31. The system of claim 30, wherein the media identifier includes at least one of a broadcast source identifier, a track identifier, or an artist identifier.

32. The system of claim 31, wherein the track identifier includes a unique identifier.

33. The system of claim 30, wherein the clearinghouse server determines the at least a portion of the enhanced media data based on the information regarding the at least one enhanced media data preference of the user.

34. A non-transitory computer-readable medium that stores instructions executable by a broadcast source to cause the broadcast source to perform a method for distributing enhanced media data, the method comprising:

assigning a unique media identifier to a media item;

storing enhanced media data associated with the unique media identifier in a data store, wherein the enhanced media data is only meta-data, wherein the meta-data is related to the broadcast media, and wherein the metadata is transmitted from the media server;

transmitting the media item and the unique media identifier to a media device via a broadcast network;

receiving, from the media device, a retrieval request including the unique media identifier and additional information related to the media device via a data network; and sending at least a portion of the enhanced media data via the data network to the media device in response to the retrieval request.

35. The non-transitory computer-readable medium of claim 34, wherein the additional information comprises at least one of media device type information and user preference information.

36. The non-transitory computer-readable medium of claim 35, wherein the method further comprises processing the media identifier and the at least one of the media device type information and the user preference information to determine the at least a portion of the enhanced media data for sending to the media device.

37. The non-transitory computer-readable medium of claim 34, wherein the additional information comprises at least one of processor type, display type, memory size, user interface type, audio features, video features, or device purpose of the media device.

38. The non-transitory computer-readable medium of claim 34, wherein the additional information comprises at least one of a preferred type of enhanced media data, a preferred format of enhanced media data, or a preferred amount of enhanced media data.

* * * * *